US007077760B2

(12) United States Patent
Gray

(10) Patent No.: US 7,077,760 B2
(45) Date of Patent: Jul. 18, 2006

(54) PUTTER KIT

(75) Inventor: William Patrick Gray, Greenville, SC (US)

(73) Assignee: Focus Golf Systems, Inc., Greenville, SC (US)

( * ) Notice: Subject to any disclaimer, the term of this patent is extended or adjusted under 35 U.S.C. 154(b) by 0 days.

(21) Appl. No.: 10/758,938

(22) Filed: Jan. 15, 2004

(65) Prior Publication Data

US 2005/0159235 A1 Jul. 21, 2005

(51) Int. Cl.
*A63B 53/02* (2006.01)

(52) U.S. Cl. ..... 473/313; 473/314; 473/340

(58) Field of Classification Search ..... 473/305, 473/309–310, 313–315, 340–341
See application file for complete search history.

(56) References Cited

U.S. PATENT DOCUMENTS

| | | | | |
|---|---|---|---|---|
| 3,848,737 | A | 11/1974 | Kenon | |
| 4,253,666 | A | 3/1981 | Murphy | |
| 5,765,691 | A | 6/1998 | Hall | |
| 5,857,922 | A * | 1/1999 | Delio | 473/313 |
| 5,906,549 | A | 5/1999 | Kublica | |
| 6,234,915 | B1 * | 5/2001 | Wu | 473/248 |
| 6,547,673 | B1 | 4/2003 | Roark | |
| 6,558,269 | B1 | 5/2003 | McBee | |
| 6,575,843 | B1 | 6/2003 | McCable | |
| 6,817,953 | B1 * | 11/2004 | Farmer | 473/251 |
| 2004/0014532 | A1 * | 1/2004 | Lee et al. | 473/340 |

FOREIGN PATENT DOCUMENTS

| | | |
|---|---|---|
| GB | 278142 | 10/1927 |
| GB | 1262896 | 2/1972 |
| GB | 1363000 | 8/1974 |
| GB | 2195901 | 4/1988 |
| GB | 2372457 | 8/2002 |

* cited by examiner

*Primary Examiner*—Stephen Blau
(74) *Attorney, Agent, or Firm*—McNair Law Firm, P.A.

(57) ABSTRACT

A kit for assembling putters of variable selected designs which includes a plurality of putter heads of varying designs, each putter head being formed with a bore in its upper surface. Also, including a plurality of hosels of varying designs, each hosel having a foot including a projection at a first end and a receptacle at a second end. Each projection being sized to fit into each of the bores in the putter heads. Further including a plurality of shafts of a plurality of lengths and flexes, each of which is sized at one end to fit into the hosel receptacles. The kit provides the components for assembling putters of selected and differing designs by choosing a specific designed putter head from the plurality of putter heads, choosing a specific designed hosel from the plurality of hosels, choosing a shaft of specific length and flexibility from the plurality of shafts and securing them together in the appropriate manner.

4 Claims, 3 Drawing Sheets

PUTTER KIT

BACKGROUND OF THE INVENTION

This invention relates to custom putter components, a method of forming custom putters and to a kit for carrying out that method.

It is usual in golf club manufacture to assemble a group of like club heads, like shafts and like grips and to assemble like clubs one after the other. In custom manufacturing, particular components of the club to be manufactured are selected from stock and assembled forming a custom club. The club elements or components are relatively standard and include grips of varying styles, shafts of varying lengths and flexibility and club heads.

For putters the putter heads consist of a sole, a top, a face and a back. The top is either plain or includes a hosel. These type structures require a very large inventory when assembling custom putters.

Accordingly, it is an object of the instant invention to provide a kit containing interchangeable selective putter components which enable the assembly of custom putters of selected designs.

Another object of the invention comprises a method of providing putter forming components, of selecting specific ones of the components and assembling them forming custom putters.

Another object of the invention is the provision of a selected group of hosels each designed to interconnect with all putter heads of a selected group of putter heads.

Another object of the invention is the provision of an inter-engaging system between the hosel and putter head which provides an engagement fixed against rotation.

Another object of the invention is an improved method of assembling custom putters.

Another object of the invention is a cost effective inventory for the manufacture of custom patterns.

SUMMARY OF THE INVENTION

The instant invention is directed to a custom made putter which includes a putter head having a sole, a top, a back and a face. Each putter head is formed in a selected shape and includes a bore formed in its top. The putter includes a hosel having a top formed with a receptacle, an elongate body and a foot. The foot includes a projection which is adapted to fit in the bore and secure with the putter head. The body portion of the hosel is formed in a selected length and shape and includes an offset elbow adjacent its top. The receptacle is formed in the elbow. A shaft of selected length and flex is provided. The shaft is sized at one end to fit into the receptacle and at its other end to support a grip. The putter is formed by uniting the hosel with the shaft and the putter head.

The body portion of the hosel is generally rectangular and formed at varying lengths. The putter head is selected from a group including cavity back, blade and mallet putter heads. Also it is preferred that the puffer head is formed entirely of a first material and the hosel of another.

The hosel foot includes a shoulder which is polygonal in shape and fits into a like shaped recess in the head when the foot is assembled. The foot provides additional stability and resists rotational movement between the hosel and the putter head.

A hosel for use with a putter head and a shaft for forming a putter. The hosel comprises an elongated body of selected length which includes a shoulder formed at a lower end thereof and an elbow formed at an upper end thereof. A projection extends downwardly from the shoulder and is adapted to engage in a bore formed in the top of the putter head. The shoulder is designed to rest in a recess formed about the bore on the top of the puffer head when the projection is engaged in the bore. The shoulder and recess have polygonal shapes which mate in locked elbow position locking the hosel against rotation. The receptacle which is formed adjacent an end of the elbow spaced from the body portion. The receptacle is adapted to receive the end of the shaft.

The body is preferably shaped in one of a circular, square or rectangular configuration. It is formed at between one and three inches in length.

The method of assembling a putter which includes the steps of:

providing a group of putter heads of differing designs with each putter head having a bore in its upper surface;

providing a group of hosels having bodies of varying lengths with each body having an elbow and receptacle at one end and a shoulder and a projection at a second end;

providing a group of shafts of varying lengths and flexes;

providing a group of grips of various sizes and shapes;

selecting individually from the groups a putter head, a hosel, a shaft and a grip; and, assembling the selected putter head, hosel, shaft and grip to form a putter of desired characteristics.

A kit for assembling putters of variable selected designs which comprises a plurality of putter heads of varying designs with each putter head having a bore and shaped recess in its upper surface. A plurality of hosels of varying designs and lengths with each hosel having a foot shaped to mate in the shaped recess at a first end and a cavity at a second end. Each foot further including a projection which is sized to precisely fit the bores in the putter heads. The kit also includes a plurality of shafts of a plurality of lengths and flexes each having a first end sized to precisely fit into the cavities and a plurality of grips of varying sizes and shapes.

The kit provides components for assembling putters of selected design by choosing a specific design putter head from the plurality of putter heads, a specific hosel from the plurality of hosels, a shaft from the plurality of shafts and a grip from the plurality of grips. The selected components are then united.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
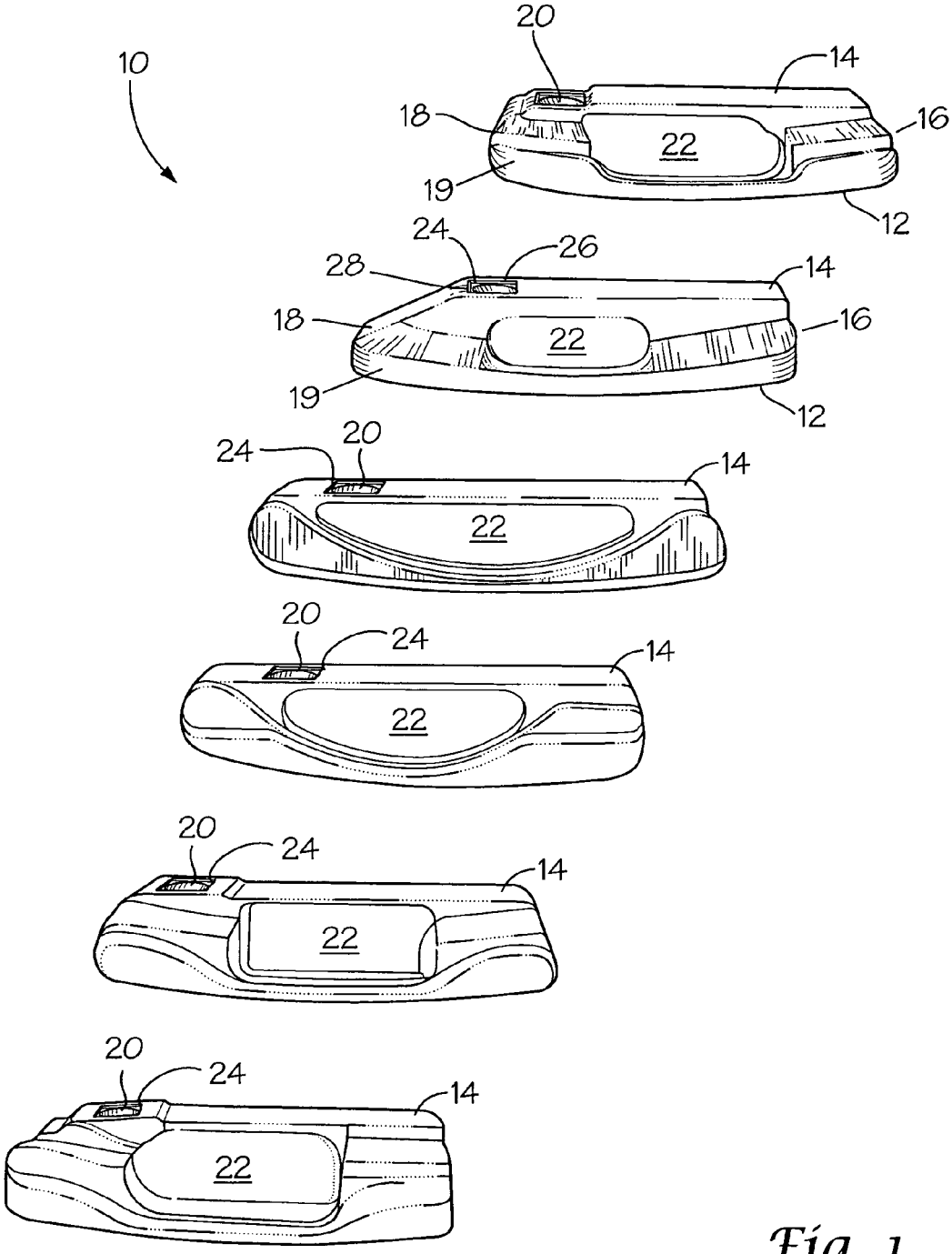
FIG. 1 is a perspective view of various cavity back putter head designs.
Figure 2A:
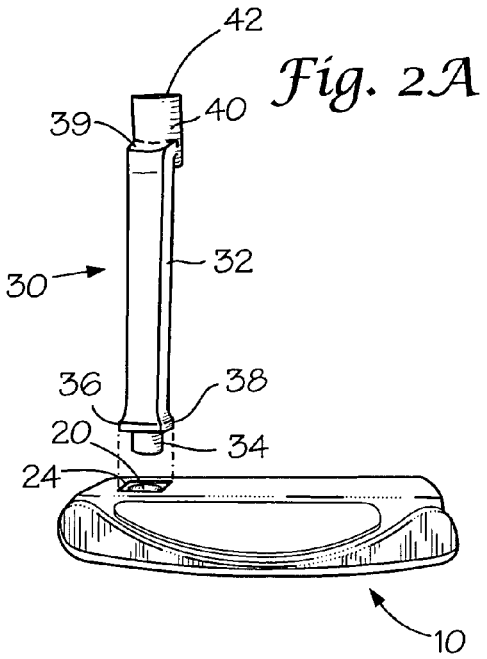
FIG. 2A is an exploded side view of a putter head and hosel.
Figure 2B:
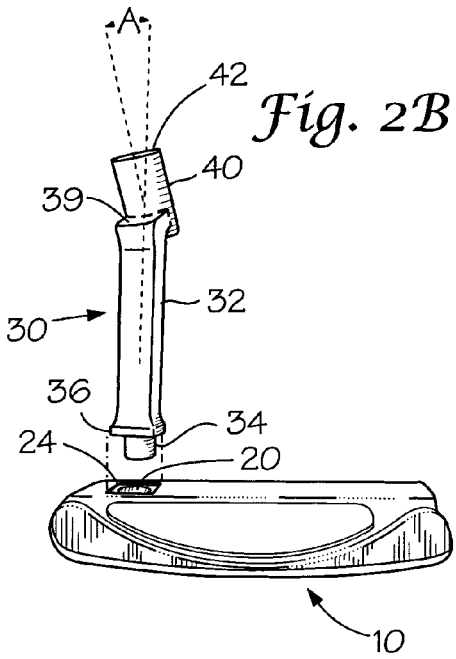
FIG. 2B is similar to FIG. 2A showing a different hosel configuration.
Figure 2C:
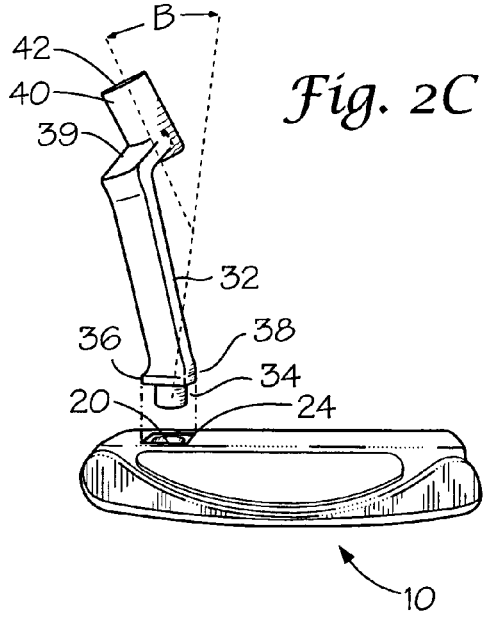
FIG. 2C is similar to FIG. 2A showing a different hosel configuration.
Figure 2D:
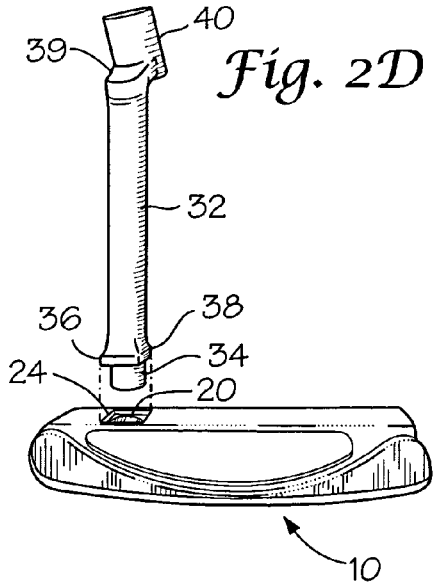
FIG. 2D is similar to FIG. 2A showing a different hosel configuration.

Turning now to the drawings, FIG. 1 shows a group of putter heads 10 of various cavity back designs. It is noted that the invention is not limited to putter heads of the cavity back design but could also include mallet head designs, blade designs or other known putter head designs.

Figure 3A:
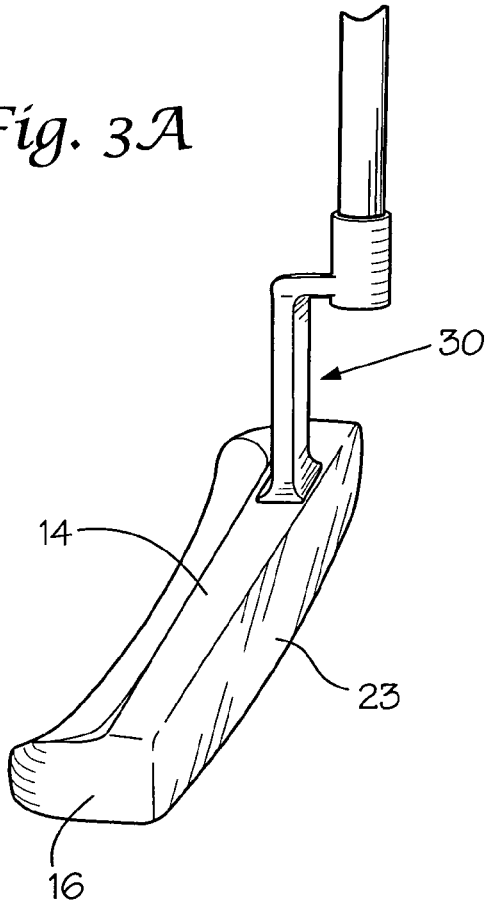
FIG. 3A is a cutaway perspective view of the hosel united with a putter head and a shaft.
Figure 3B:
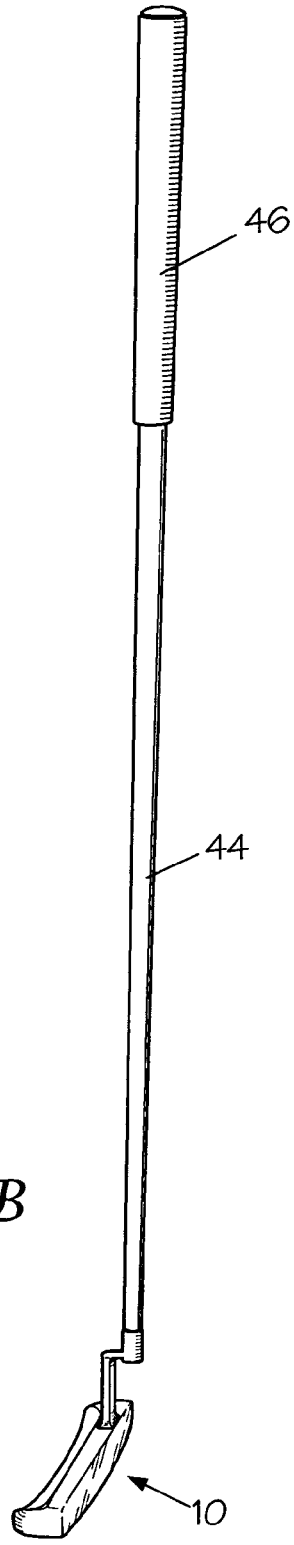
FIG. 3B is a perspective view of a putter formed from the components of FIGS. 1 and 2.

Putter heads 10 each include a sole 12, a top 14, opposed ends 16, 18 and a back 19 having a cavity or bore 20. Face 23 shown in FIG. 3 is arranged opposite back 19. The various putter head shapes thus far described are usual and form no part of the invention.

Each top 14 has a bore 20 formed therein, normally adjacent an end thereof. It is noted bore 20 could be located centrally of top 14 or centrally thereof. Bore 20 is preferably formed vertically or at 90° to the sole of the putter. Bore 20 is preferably cut to a depth of about 16 mm and is preferably formed at a width of about 8.5 mm. It is noted that the width ad depth of the bore can vary as desired. The bore also could be formed at a slight angle to vertical, however, it is preferred that the bore be vertical as the hosels are designed to position the shafts at various angles as will be later discussed.

About each bore 20 there is formed a recess 24. Recess 24 is preferably rectangular with vertical walls which are about 2 mm in height and a substantially flat bottom. Front and rear walls 26 are preferably spaced by about 9.6 mm while left and right side walls 28 are preferably spaced by about 13.5 mm. It is noted that the height and spacing of walls 26, 28 can be varied as desired. Recess 24 may be formed in other shapes as will be later discussed.

Turning now to FIG. 2 hosels 30 are shown as being formed in various shapes and sizes in spaced position above bore 20. Hosel 30 as shown includes body portion 32, an outwardly flared or extending shoulder 36 adjacent its lower end position and a projection 34 extending downwardly beneath shoulder 36. An elbow 39 is arranged at the upper end of body 32 and extends outwardly in a selected direction at selected and varying distances. A receptacle 40 is attached to the outer end of elbow 39 and is formed with an upwardly directed opening 42. Receptacle 40 is designed to receive and retain the end of the shaft 44 as shown in FIG. 3. Receptacle 40 is attached to elbow 39 with the axis of opening 42 arranged at a selected angle A as shown in FIG. 2B. In the arrangement shown in FIG. 2C both the hosel body 32 and receptacle 40 are arranged at angle B to the vertical. In FIG. 2A the body 32, to include receptacle 40, is arranged along the vertical axis. In FIG. 2D body 32 of hosel 30 is shown as round.

The angles A, as shown at A, B, determine the angle of shaft 44 relative to sole 12 of the putter head. Accordingly, the hosels of the group of hosels shown in FIG. 2 include receptacles 40 which may be arranged along various angles A relative to the vertical axis of body 32 allowing another variable in the selection of components when choosing the desired putter. Also, both the receptacle and body may be arranged along various angles B also providing a variable selection.

Body 32 is shown as being rectangular and round. It could also be square, hexagonal or any other desired configuration. Body 32 may vary between 1" to 6" in length.

Formed at the lower end of body 32 is shoulder 36 which flares outwardly from the body and is preferably rectangular in shape but could be of any plural sided configuration. The term polygon identifies a multi-sided configuration. The shape of the shoulder along with the shape of the recess and hosel body are hereafter referred to as polygonal.

Shoulder 36 terminates in a plurality of sides 38 which intersect forming a polygonal configuration which matches and fits into the polygonal configuration of recess 24. Sides 38 are formed to be about 2 mm in height so as to generally terminate at or just beyond the upper surface of recess 24.

As earlier stated, shoulder 36 can be of any desired multi-sided configuration although rectangular is preferred.

Beneath shoulder 36, projection 34 extends downwardly about 15 mm and is about 8.5 mm in width. Projection 34 is formed with a plurality of vertically extending sides and a planar bottom surface. The number of sides provided is determined by the number of walls in the recess 24 in which shoulder 36 is intended to fit. The shoulder projection arrangement 34, 36 is designed to snugly fit into the bore recess arrangement 20, 24 in the manner shown in FIG. 3 with the recess 24, shoulder 36 fitting together to provide a position fixed against rotation.

Any usual type of glue or cement is used to fix the putter head and shaft with the hosel. Also, the hosel and putter head may be made of any plastic, metal or combination thereof normally associated with the manufacture of golf clubs.

While a preferred embodiment of the invention has been described using specific terms, such description is for illustrative purposes only, and it is to be understood that changes and variations may be made without departing from the spirit or scope of the following claims.

What is claimed is:

1. A custom putter comprising:

a putter head, formed entirely of a first material, having a sole, a top, a back and a face each formed in a desired shape;

a polygonal shaped recess, having a bottom surrounded with vertical walls of approximately 2 mm in height, formed in said first material and said top of said putter head;

a bore formed in said bottom of said polygonal shaped recess;

a hosel, formed entirely of a second and different material, having an elongated rectangular shaped body of between 1 and 3 inches in length with an upper portion and a foot; said foot including an outwardly flared polygonal shaped shoulder having vertical sides of about 2 mm and a lower surface from which a projection is downwardly directed;

said hosel further including an elbow with a receptacle adjacent said upper portion;

a shaft of desired length and flex, said shaft being sized at a first end to fit into said receptacle and at a second end to support a grip; wherein, said putter is formed with said hosel connected with said putter head with said projection extending into and being secured with said bore, with said lower surface of said outwardly flared shoulder in engagement with said bottom of said recess, with said vertical sides of said outwardly flared shoulder in engagement with said first material forming said vertical walls of said recess, with said outwardly flared shoulder merging with said top of said putter head, and with said shaft end engaged in said receptacle.

2. The custom putter of claim 1 wherein said putter head is selected from a group including cavity back, blade and mallet.

3. The custom puller of claim 1 wherein said bore and said recess are arranged at selected angles relative to the longitudinal axis of said body.

4. The custom putter of claim 1 wherein said putter head is formed of one of plastic and metal.

* * * * *